United States Patent [19]

Howitt

[11] 4,086,858

[45] May 2, 1978

[54] WALL FIXTURE

[75] Inventor: Robert T. Howitt, Leominster, Mass.

[73] Assignee: Frem Corporation, Worcester, Mass.

[21] Appl. No.: 764,822

[22] Filed: Feb. 2, 1977

[51] Int. Cl.[2] ..... A47B 9/00

[52] U.S. Cl. ..... 108/110; 211/153; 211/187; 248/243

[58] Field of Search ..... 108/110, 144, 152, 107; 211/128, 134, 135, 153, 190, 187; 248/241-243, 247-250

[56] References Cited

U.S. PATENT DOCUMENTS

| | | | |
|---|---|---|---|
| 768,295 | 8/1904 | Palfrey | 248/243 |
| 863,068 | 8/1907 | Huff et al. | 248/243 |
| 2,579,704 | 12/1951 | Saul | 108/110 X |

*Primary Examiner*—James C. Mitchell

*Attorney, Agent, or Firm*—Norman S. Blodgett; Gerry A. Blodgett

[57] ABSTRACT

Wall fixture including a rail having downwardly-directed slots formed on its outer surface and a shelf element having angular fins which fit into the slots for locking it to the rail.

6 Claims, 9 Drawing Figures

WALL FIXTURE

BACKGROUND OF THE INVENTION

It has been suggested in patent application Ser. No. 707,669 filed July 22, 1976, the shelves can be readily mounted on a wall by providing two spaced, parallel, vertical rails, each having a plurality of angular slots and by providing the shelf with angularly-directed vanes which fit in a pair of slots, one in each of the two rails. While this construction is very useful, there are situations where the shelf element is not wide enough to span two rails, thereby gaining the stability offered by the double connection. For instance, the problem can arise in the case of a short shelf which is only wide enough to be attached to one rail, or in the case of a shelf bracket where it is desirable to attach one bracket to each of a plurality of rails and, subsequently, to lay a shelf board across the brackets. Not only does the lock of stability which is inherent in this arrangement allow the shelf element to reside at an angle to the rail (so that it has a perculiar or unsatisfactory appearance), but, when valuable bric-a-brac are to be carried on such shelf element, instability offers the possibility of the supported item falling on the floor and breaking. These and other difficulties experienced with the prior art devices have been obviated in a novel manner by the present invention.

It is, therefore, an outstanding object of the invention to provide a wall fixture including a shelf element mounted on a single vertical rail by means of a slot-and-fin arrangement, wherein means is provided to stablize the connection against angular movement of the shelf element relative to the rail.

Another object of this invention is the provision of a wall fixture having a novel connection between a shelf element and a single vertical rail.

A further object of the present invention is the provision of a shelf element having angular fins and integral flanges that can be formed in a simple mold without a side action mechanism.

It is another object of the instant invention to provide a shelf element of complex form which is, nevertheless, drawable from a mold.

A still further object of the invention is the provision of a wall fixture consisting of a rail and a shelf and which is capable of a long life of useful service with a minimum of maintenance.

It is a further object of the invention to provide a wall fixture of a very adaptable nature, in which the vertical rails may be used in any selected length and number and in which a variety of shelf elements are available for use with the rails, thus permitting the user to select a combination of rails and shelf elements to suit his taste and needs.

It is a still further object of the present invention to provide a wall fixture made up of a plurality of elements, wherein the basic design permits the free selection of color combinations to suit a given decor.

Another object of the invention is the provision of a wall fixture consisting of a plurality of elements which are easily dis-assembled for washing or changing.

Another object of the invention is the provision of a wall fixture all of whose elements are capable of being easily and simply manufactured by the injection molding process.

With these and other objects in view, as will be apparent to those skilled in the art, the invention resides in the combination of parts set forth in the specification and covered by the claims appended hereto.

SUMMARY OF THE INVENTION

In general, the invention consists of a wall fixture having a rail which is adapted to be fastened to a wall surface in a vertical aspect. The rail is formed with a plurality of slots which enter a vertical front surface of the rail which faces away from the wall surface, each slot extending inwardly and downwardly at a substantial angle to the vertical. A shelf element is provided having a vertical rear surface which is adapted to lie against the front surface of the rail and which has a plurality of ribs extending from the said rear surface for locking engagement with corresponding slots in the rail. The shelf element has two spaced, parallel flanges which lie on either side of the ribs and closely embrace the rail.

More specifically, each rib is integral with a flange and the rail is provided with spaced, parallel side surfaces lying at right angles to the said vertical front surface for engagement with the inner surfaces of the flanges. In one species of the shelf element, the flanges are coextensive and extend vertically entirely across the said rear surface of the shelf element. In another species of the shelf element, the flanges are non-coextensive and the lower end of one flange is integral with one side of a rib, while the upper end of the other flange is integral with the other side of the same rib.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
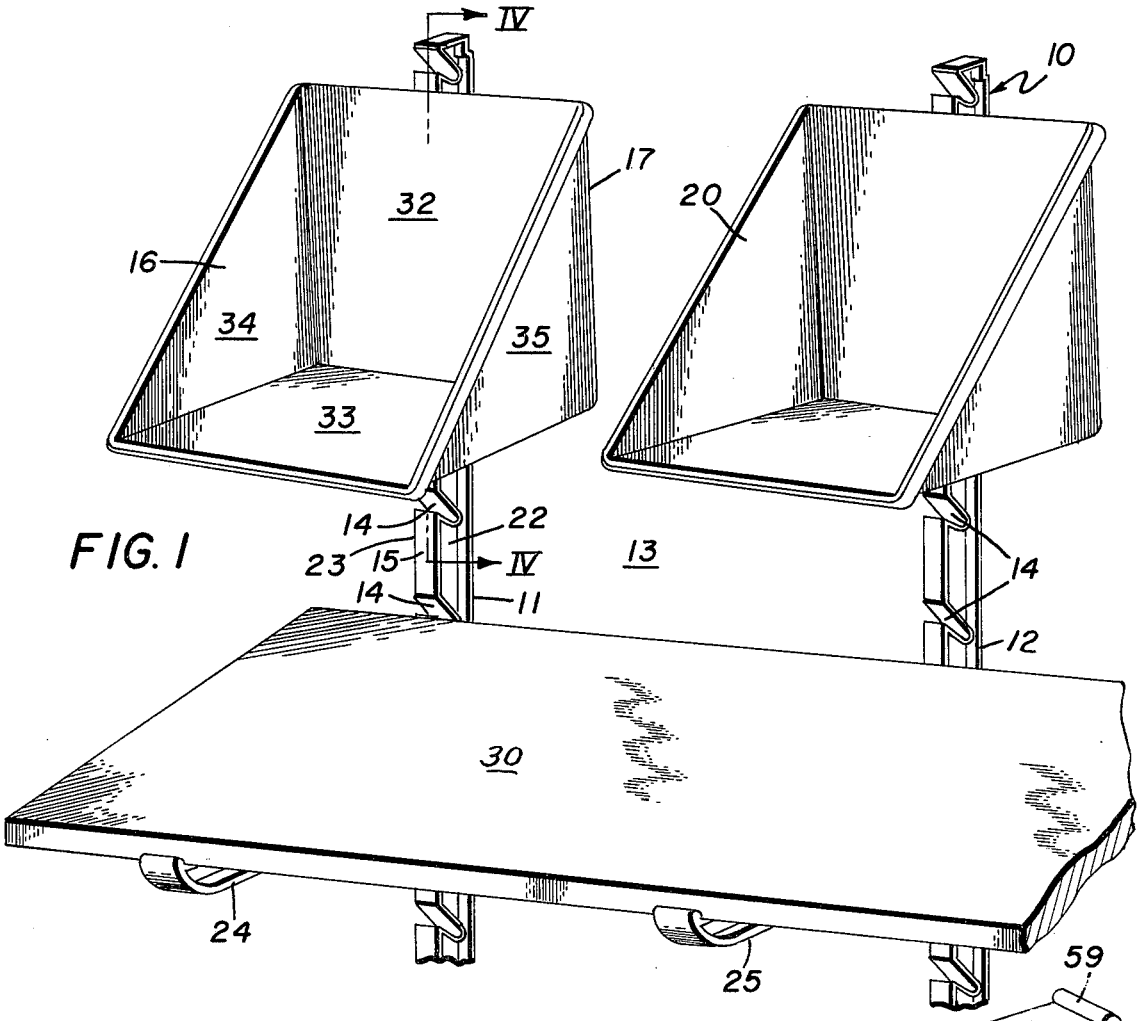
FIG. 1 is a perspective view showing a wall fixture embodying the principles of the present invention.

Referring first to FIG. 1, wherein are best shown the general features of the invention, the wall fixture, indicated generally by the reference numeral 10, is shown as having two rails 11 and 12 fastened to a wall in spaced, parallel relationship and extending vertically of the wall surface 13. The rails are provided with a plurality of tapered slots 14 which are evenly spaced. These slots enter a vertical front surface 15 of the rail, which surface faces away from the wall surface, and each slot extends inwardly and downwardly at a substantial angle to the vertical and to the horizontal; in the preferred embodiment this angle is 45°.

Mounted on the rails are a plurality of shelf elements, all of which have similar features for attachment to the rails. The shelf element 16 is attached to the rail 11 and is provided with a rear surface 17 which lies against the front surface 15 of the rail.

Figure 4:
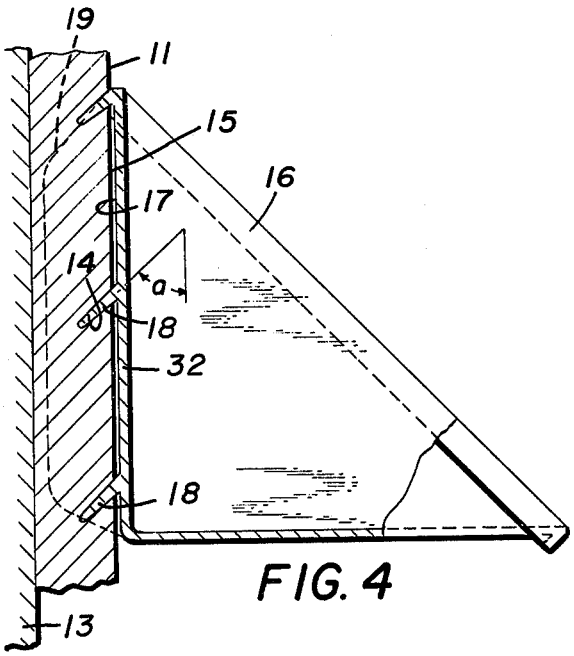
FIG. 4 is a vertical sectional view of the invention taken on the line IV—IV of FIG. 1.
Figure 5:
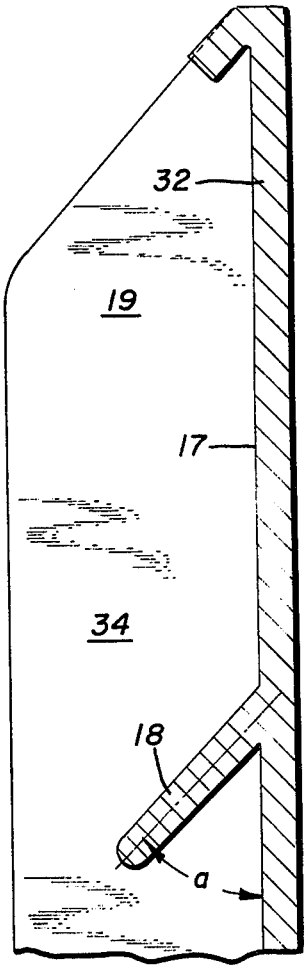
FIG. 5 is an enlarged section of the element shown in FIG. 4.
Figure 6:
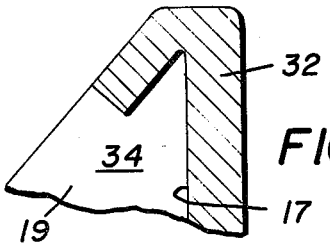
FIG. 6 is a further enlarged view of a portion of FIG. 5.
Figure 7:
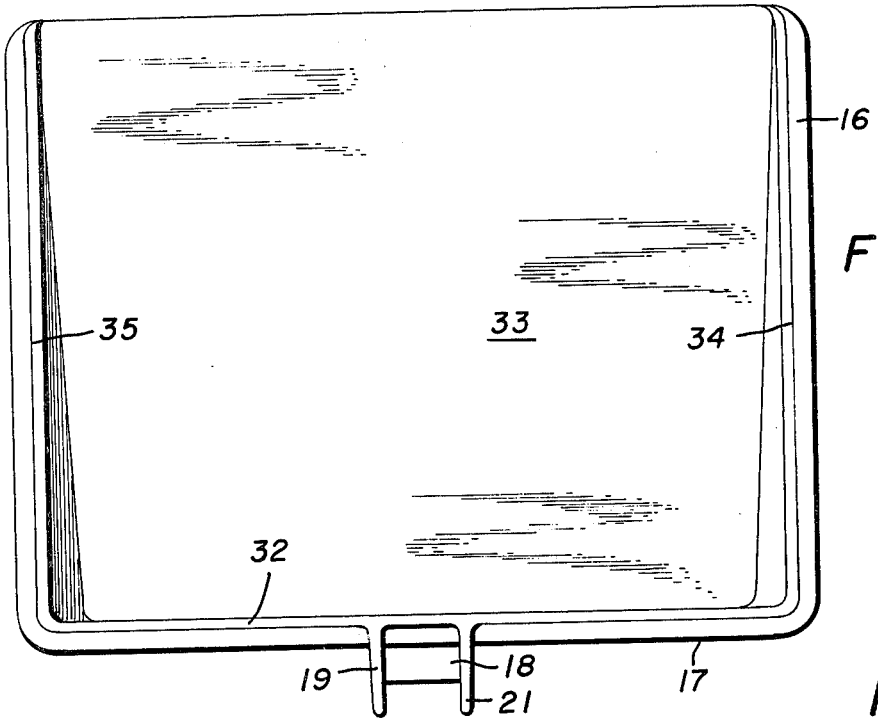
FIG. 7 is a plan view of the shelf element shown in FIG. 4.

FIGS. 4–8 show the details of the shelf element 16. Particularly, FIG. 4 shows the manner in which the inclined tapered ribs 18 extend from the rear surface 17 of the element and engage the similarly-shaped slots 14 of the rail. Two vertical flanges 19 and 21 lie on either side of the ribs in spaced, parallel relationship and closely embrace the side surfaces 22 and 23, respectively, of the rail 11. As is evident from the drawings, each rib 18 is integral with the flanges 19 and 21. These flanges are coextensive with one another and extend vertically entirely along the rear surface 17 of the shelf element 16; each rib is integral with and extends entirely between the flanges. The shelf element 20, which is attached to the rail 12, is exactly the same as the shelf element 16.

Figure 2:
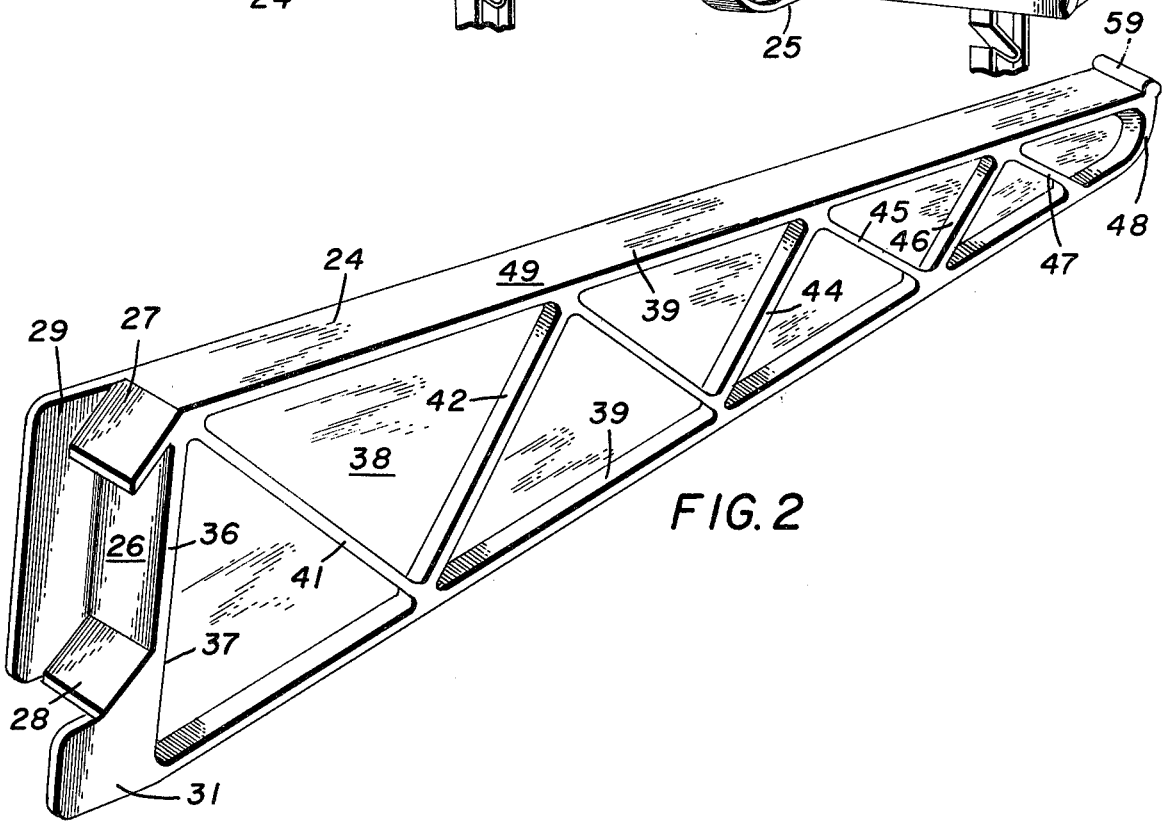
FIG. 2 is a perspective view of a shelf element forming part of the present invention.
Figure 3:
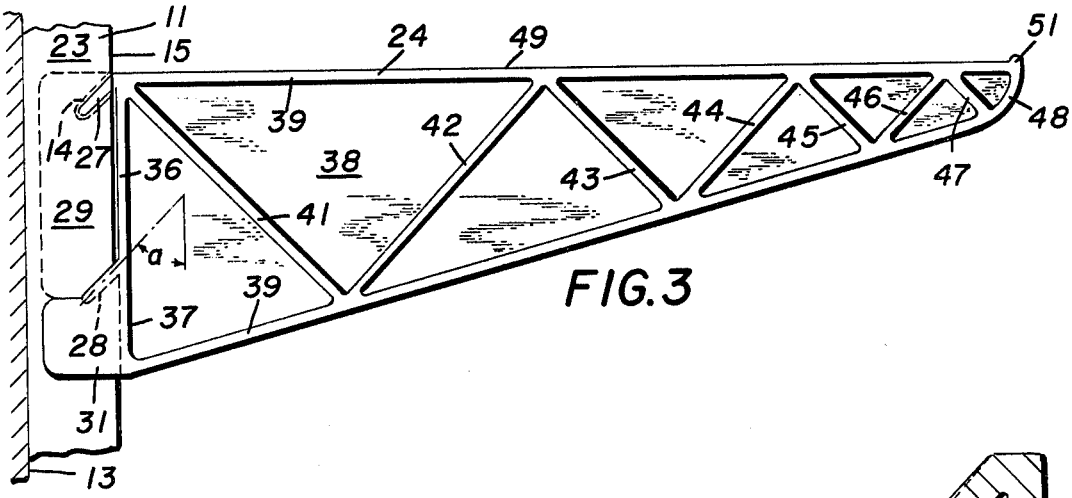
FIG. 3 is a side elevational view of the shelf element shown in FIG. 2.

FIGS. 2 and 3 show the details of a shelf element 24 which is attached to the rail 11. Another shelf element 25, which is exactly similar to the element 24 is attached to the rail 12. A shelf 30 extends across the two shelf elements 24 and 25. The shelf element 24 is provided with a rear surface 26 adapted to lie against the front surface 15 of the rail and is provided with downwardly-extending tapered ribs 27 and 28 which lie in locking engagement with the slots 14 of the rail. Also extending from the rear surface are spaced, parallel flanges 29 and 31 which lie on either side of the ribs 27 and 28. The flanges 29 and 31 are non-coextensive, the lower end of the flange 29 being integral with one side of the rib 28, while the upper end of the other flange 31 is integral with the other side of the same rib.

Referring again to FIGS. 4–8, it can be seen that the shelf element 16 is integrally formed as an injection molded plastic with a rear wall 32 (which carries the rear surface 17), a bottom wall 33, and side walls 34 and 35 which join the rear wall to the bottom wall.

Referring again to FIGS. 2 and 3, the shelf element 24 is shown as a bracket having a rear wall 36 carrying the aforementioned rear surface 26 and having a front surface 37 in the form of an elongated, vertically-orientated rectangle from which extends (at a right angle) a vertically-orientated web wall 38. This web wall has the general shape of a right triangle with a short side lying along the rear wall 36, another side at a right angle thereof constituting an upper horizontal side and the hypotenuse constituting the under edge. A flange 39 extends outwardly from most of the periphery of the web wall 38 in both directions and at a right angle to its surface. A plurality of flanges 41, 42, 43, 44, 45, 46, and 47 extend between portions of the peripheral flange 39. The vertix of the triangular web wall 38 is provided with a round end 48 and the upper portion of the flange 39 has a flat horizontal surface 49 for supporting the shelf 30. It terminates in an upwardly-extending stop abutment 59.

Figure 9:
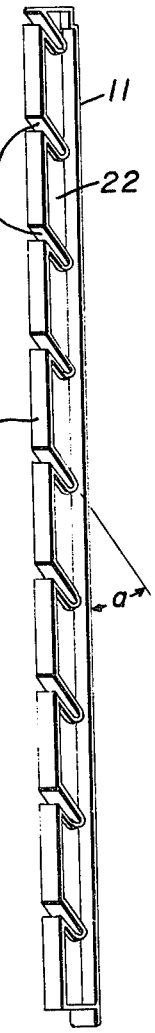
FIG. 9 is a perspective view of a rail forming part of the wall fixture.
Figure 8:
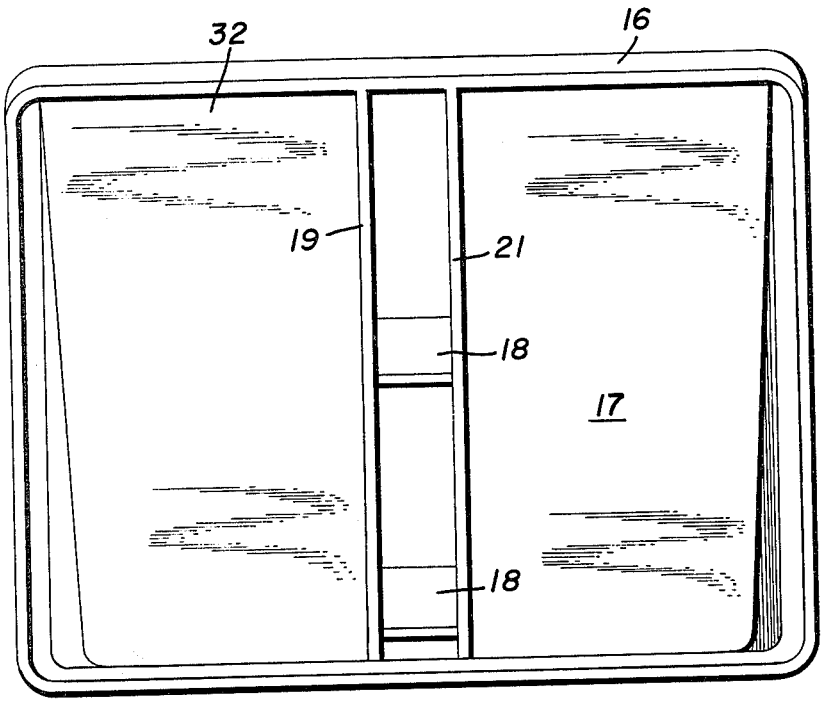
FIG. 8 is a rear elevational view of the shelf element of FIG. 4.

FIG. 9 shows the perspective view of the rail showing the slots 14, the front surface 15, and one of the side surfaces 22. It is interesting to note that the sides of the rail are recessed, but the surface 22 which is embraced by the flanges on the shelf elements are the unrecessed portions of the sides.

The operation and the advantages of the present invention will now be readily understood in view of the above description. Once the rails 11 and 12 have been mounted on the wall surface 13, it is possible to use the shelf elements in a variety of ways. FIG. 1 shows one of these ways, which includes the use of two of the shelf elements 24 and 25 supporting a shelf and two of the shelf elements 16 and 20 which are independently mounted on their respective rails. In both cases the ribs 18 of the shelf element 24 (see FIGS. 7 and 8) are located in the slots 14 on their respective rails. In both cases, the stability of the shelf element is determined by the fact that flanges embrace the side surface 22 and 23 of the rail. The shelf element 24 is particularly adaptable to production by the injection molding method, since the non-coextensive nature of the flanges 29 and 31 joined by the rib 28 allows the pattern to be "drawn" using a center line down the middle of the web 38 as the parting line. The shelf element 16, of course, lends itself readily to the injection molding process, and does not require a side action mechanism in the mold for the spaces between the ribs 18. The elements are readily dismountable from their rails for washing and changing. It may be desirable, also, to use different colors for decorative purposes. The fact that the elements are made of plastic means, particularly in the case of the shelf elements 16 and 20, that a little water from plants will not harm the shelf elements. If the article placed on the shelf 16 is slightly out of balance, the fact that the flanges 19 and 21 tightly embrace the sides of the rail means that the shelf is capable of resisting the force couple produced by such an imbalance.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Wall fixture, comprising:

(a) a molded plastic rail adapted to be fastened to a wall surface in a vertical aspect, the rail being formed with a plurality of narrow slots which enter a broad vertical front surface of the rail facing away from the wall surface, each slot extending inwardly and at a substantial angle to the vertical rail being formed with spaced, parallel side surfaces lying at right angles to the said vertical front surface, (b) a molded plastic shelf-element having a broad vertical rear surface adapted to lie against the said front surface of the rail, having a plurality of thin ribs extending from the said rear surface for locking engagement with corresponding slots in the rail, and having two vertical flanges lying on either side of and integral with at least one of the ribs in spaced parallel relationship and closely embracing the said side surfaces of the rail.

2. Wall fixture as recited in claim 1, wherein the flanges are coextensive and extend vertically entirely across the said rear surface of the shelf element, each rib being integral with and extending completely between the flanges.

3. Wall fixture as recited in claim 1, wherein the flanges are non-coextensive, the lower end of one flange being integral with one side of a rib, while the upper end of the other flange is integral with the other side of the same rib.

4. Wall fixture as recited in claim 1, wherein the shelf-element includes a rear wall, a bottom wall extending at a right angle to the rear wall, and a pair of spaced parallel side walls joining the rear and bottom walls.

5. Wall fixture as recited in claim 1, wherein the shelf-element is a bracket having a rear wall with the said rear surface on one side and a front surface, a vertical web wall extending at a right angle to the said front surface of the rear wall, the web wall having a generally right triangular shape, a flange extending outwardly from the periphery of the web wall, and a plurality of flanges extending across the web wall from one part of the peripheral web wall from one part of the peripheral web to another part.

6. Wall fixture as recited in claim 5, wherein the vertex of the triangular web wall away from the rear wall is rounded, and wherein the upper edge flange has a flat horizontal surface for supporting a shelf and terminates in an upwardly-extending stop abutment.

* * * * *